US006523309B1

(12) United States Patent
Finlay et al.

(10) Patent No.: US 6,523,309 B1
(45) Date of Patent: Feb. 25, 2003

(54) FASTENING PLATE

(75) Inventors: Shane Finlay, Guelph (CA); Pieter Greidanus, London (CA)

(73) Assignee: Armtec Limited, Guelph (CA)

( * ) Notice: Subject to any disclaimer, the term of this patent is extended or adjusted under 35 U.S.C. 154(b) by 0 days.

(21) Appl. No.: 09/900,860

(22) Filed: Jul. 10, 2001

(30) Foreign Application Priority Data

Jul. 9, 2001 (CA) ..... 2352659

(51) Int. Cl.[7] ..... E02D 19/00; E04B 1/38; F16B 43/02

(52) U.S. Cl. ..... 52/169.5; 52/410; 52/506.05; 52/512; 52/712; 52/745.21

(58) Field of Search ..... 52/410, 411, 408, 52/409, 698, 512, 514, 506.01, 513, 169.5, 506.05, 712, 745.21; 405/36, 38, 45; 411/371.2, 372, 531, 545

(56) References Cited

U.S. PATENT DOCUMENTS

| | | | | | |
|---|---|---|---|---|---|
| 256,007 | A | * | 4/1882 | Knell | 472/76 |
| 1,111,034 | A | * | 9/1914 | Robertson | 411/545 |
| 2,086,086 | A | | 7/1937 | Lassonde | |
| 4,162,597 | A | * | 7/1979 | Kelly | |
| D271,662 | S | * | 12/1983 | Jones | D8/399 |
| 4,467,581 | A | * | 8/1984 | Francovitch | 52/410 |
| 4,476,660 | A | * | 10/1984 | Francovitch | 52/515 |
| 4,520,606 | A | | 6/1985 | Francovitch | |
| 4,574,551 | A | | 3/1986 | Giannuzzi | |
| 4,744,187 | A | | 5/1988 | Tripp | |
| 4,763,456 | A | * | 8/1988 | Giannuzzi | 52/410 |
| 4,780,039 | A | | 10/1988 | Hartman | |
| 4,787,188 | A | * | 11/1988 | Murphy | 52/410 |
| 4,788,807 | A | | 12/1988 | Whitman | |
| 4,977,721 | A | * | 12/1990 | Blosseville et al. | 52/410 |
| 5,102,275 | A | * | 4/1992 | Hulsey | 411/134 |
| 5,415,511 | A | | 5/1995 | Damron | |
| 5,622,020 | A | * | 4/1997 | Wood | 52/546 |
| 5,934,855 | A | * | 8/1999 | Osterle et al. | 411/545 |
| 5,951,225 | A | * | 9/1999 | Osterle et al. | 411/545 |
| 6,205,730 | B1 | * | 3/2001 | Hasan et al. | 52/408 |
| 6,238,766 | B1 | * | 5/2001 | Massett et al. | 428/99 |
| 6,250,034 | B1 | * | 6/2001 | Hulsey | 52/410 |
| 6,282,857 | B1 | * | 9/2001 | Rubenacker | 52/410 |
| 6,315,489 | B1 | * | 11/2001 | Watanabe | 403/381 |
| 2002/0139068 | A1 | * | 10/2002 | Janesky | |

FOREIGN PATENT DOCUMENTS

| | | |
|---|---|---|
| DE | 33 02 244 A | 7/1984 |
| DE | 94 04 700 U | 7/1995 |
| WO | 91 10782 A | 7/1991 |
| WO | 95 25850 | 9/1995 |

* cited by examiner

*Primary Examiner*—Robert Canfield

(57) ABSTRACT

The invention provides a fastening plate for securing a membrane to a substrate. The membrane has an inner side to be positioned adjacent to the substrate and an outer side disposed opposite to the inner side, and the membrane also has a dimpled portion including an array of dimples and a substantially smooth top portion. The dimples form depressions on the outer side and corresponding projections from the inner side. The fastening plate has a mating portion including a contact side to be positioned adjacent to the outer side of the membrane, a biasing portion extending from the mating portion. The mating portion includes an array of locator elements projecting inwardly from the contact side for cooperating with a corresponding number of the dimples to position the mating portion on the dimpled portion. The mating portion is adapted to receive at least one fastener.

19 Claims, 16 Drawing Sheets

FASTENING PLATE

FIELD OF THE INVENTION

The invention relates to the field of fastening plates for use with fasteners to secure membranes to substrates and, in particular, a fastening plate for securing a membrane to a substrate forming a foundation wall of a structure.

BACKGROUND OF THE INVENTION

Fastening plates are known which, when used with a fastener, secure a membrane to a substrate. For example, known fastening plates are used to fasten roofing sheets to a roof, as disclosed in U.S. Pat. No. 5,951,225 (Osterle et al.). Among other things, a fastening plate for use with roofing sheets is typically intended to provide a waterproof seal where the fastening plate meets the membrane.

A high density polyethylene membrane for use with building foundations is known. The membrane is designed to minimize the amount of water which enters a building through that part of the foundation which is below the surface of the surrounding soil. The membrane has a dimpled portion which includes an array of dimples, and a top portion which is substantially smooth. Because it is dimpled, the membrane holds soil and moisture in the soil away from the foundation wall, and provides an air gap between the membrane and the foundation wall exterior. Typically, the membrane is secured to the foundation wall exterior along a top portion of the membrane, so that the membrane hangs like a curtain over the foundation wall.

After the membrane is secured to the foundation wall, soil is backfilled against the membrane. A foundation drainage tile is typically installed at the foundation footings. Any moisture which does get past the membrane moves through the air gap to the foundation drainage tile, and is drained away through the tile.

It is important that the top portion of the membrane be well secured to the foundation wall so that soil will not fill the air gap and clog the drainage path. The top portion of the membrane typically is fastened by a plurality of fasteners installed with a plurality of washers in the top portion, as is known in the art, and a plurality of additional fasteners and washers, in the dimpled portion of the membrane. Depending on the circumstances, a relatively large number of fasteners and washers may be needed.

There is a continuing need for an improved fastening plate for securing a membrane having a dimpled portion and a smooth top portion to a substrate.

SUMMARY OF THE INVENTION

In a broad aspect of the present invention, there is provided a fastening plate for securing a membrane to a substrate. The membrane has an inner side to be positioned adjacent to the substrate and an outer side disposed opposite to the inner side, and a dimpled portion including an array of dimples and a substantially smooth portion. The dimples form depressions on the outer side of the membrane and corresponding projections from the inner side. The fastening plate has a mating portion including a contact side to be positioned adjacent to the outer side of the membrane and an exposed side disposed opposite to the contact side, and a biasing portion extending from the mating portion, for urging the smooth portion of the membrane against the substrate. The mating portion includes an array of locator elements projecting inwardly from the contact side and adapted to cooperate with a corresponding number of the dimples to position the mating portion on the dimpled portion. The mating portion is adapted to receive at least one fastener for securing the fastening plate to the substrate.

In another aspect there is provided an improvement in a sheathing assembly for securing a membrane to a substrate. The sheathing assembly includes the membrane, a fastening plate and at least one fastener, the fastening plate having at least one aperture for receiving the fastener. The membrane has a dimpled portion including an array of dimples, and a smooth portion which is substantially planar. The membrane also has an inner side to be positioned adjacent to the substrate and an outer side disposed opposite the inner side. The dimples form depressions on the outer side of the membrane and corresponding projections from the inner side. The fastening plate has a contact side to be positioned adjacent to the outer side of the membrane and an exposed side disposed opposite the contact side. The sheathing assembly also includes the improvement in which the fastening plate has an array of locator elements projecting inwardly from the contact side and adapted to cooperate with a corresponding number of dimples formed on the outer side of the membrane to position the fastening plate on the dimpled portion.

In yet another aspect, there is provided a method of securing a membrane to a substrate by a fastening plate and at least one fastener, the membrane having a dimpled portion including an array of dimples and a smooth portion which is substantially planar. The membrane has an inner side to be positioned adjacent to the substrate and an outer side disposed opposite the inner side, the dimples forming depressions on the outer side and corresponding projections from the inner side. The fastening plate has a contact side to be positioned adjacent to the outer side of the membrane, and an exposed side disposed opposite the contact side. The fastening plate also has a mating portion including an array of locator elements projecting inwardly from the contact side and adapted to cooperate with a corresponding number of dimples and at least one aperture for receiving the at least one fastener, and a biasing portion, the biasing portion extending from the mating portion. The method includes placing the inner side of the membrane adjacent to the substrate, placing the contact side of the fastening plate adjacent to the outer side of the membrane, positioning the fastening plate relative to the dimpled portion and the smooth portion by cooperation of the locator elements with a corresponding number of dimples, so that the mating portion is disposed on the dimpled portion and the biasing portion is disposed on the smooth portion, and inserting the at least one fastener through the at least one aperture to secure the fastening plate to the substrate, so that the biasing portion urges the smooth portion against the substrate.

In yet another aspect, there is provided a fastening plate for securing a membrane to a substrate. The membrane has an inner side to be positioned adjacent to the substrate and an outer side disposed opposite to the inner side, and a dimpled portion including an array of dimples and a substantially smooth top portion. The dimples form depressions on the outer side of the membrane and corresponding projections from the inner side. The fastening plate has a mating portion including a contact side to be positioned adjacent to the outer side of the membrane and an exposed disposed opposite to the contact side. The mating portion includes at least one aperture for receiving at least one fastener. The mating portion includes an array of locator elements projecting inwardly from the contact side and adapted to cooperate with a corresponding number of the dimples to position the mating portion on the dimpled portion so that the aperture is positioned between the dimples.

BRIEF DESCRIPTION OF THE DRAWINGS

The invention will be better understood with reference to the attached drawings, in which.

DETAILED DESCRIPTION OF THE PREFERRED EMBODIMENT(S)

Figure 1:
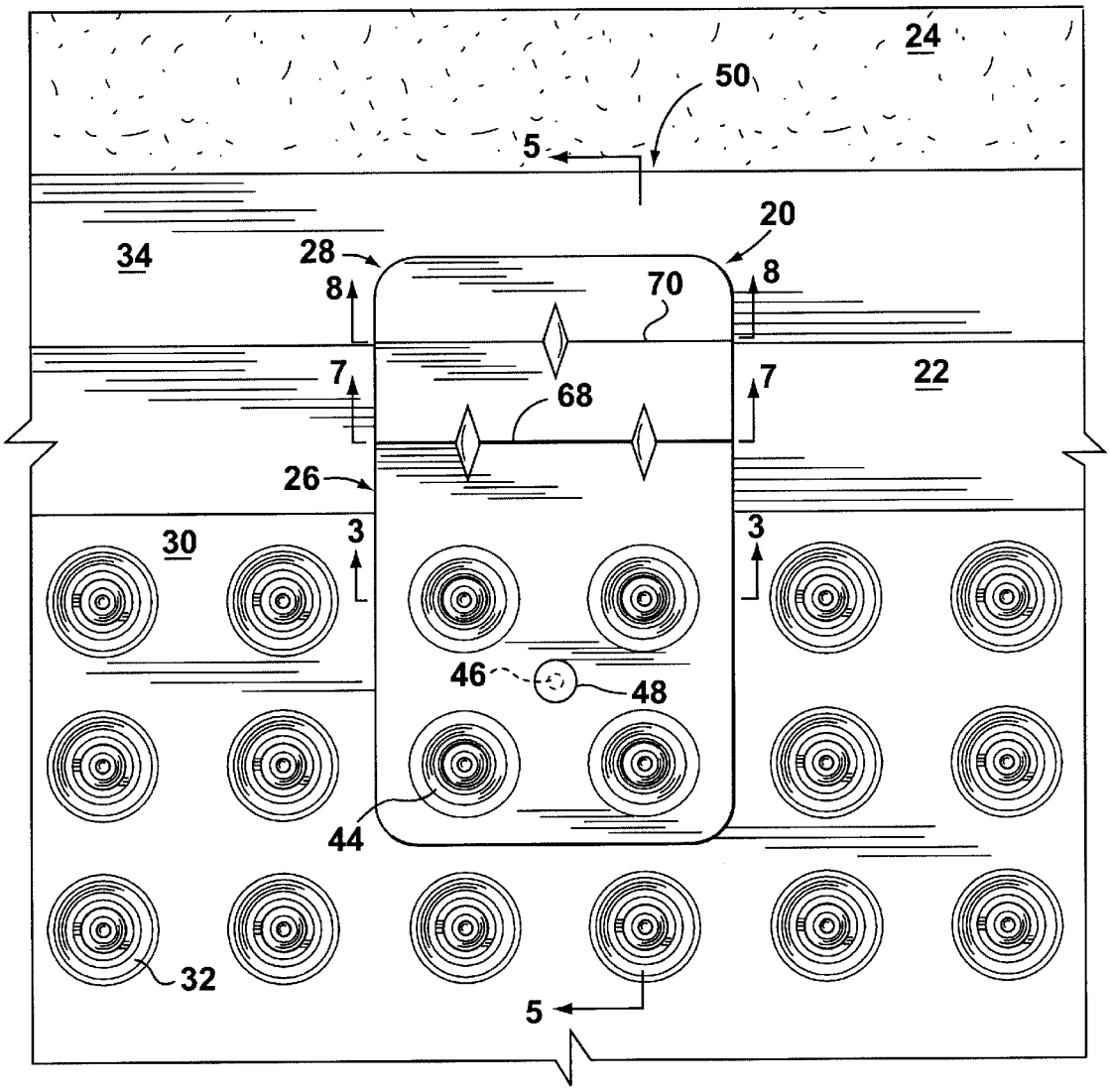
FIG. 1 is a front view of a preferred embodiment of a fastening plate securing a membrane against a substrate.
Figure 1A:
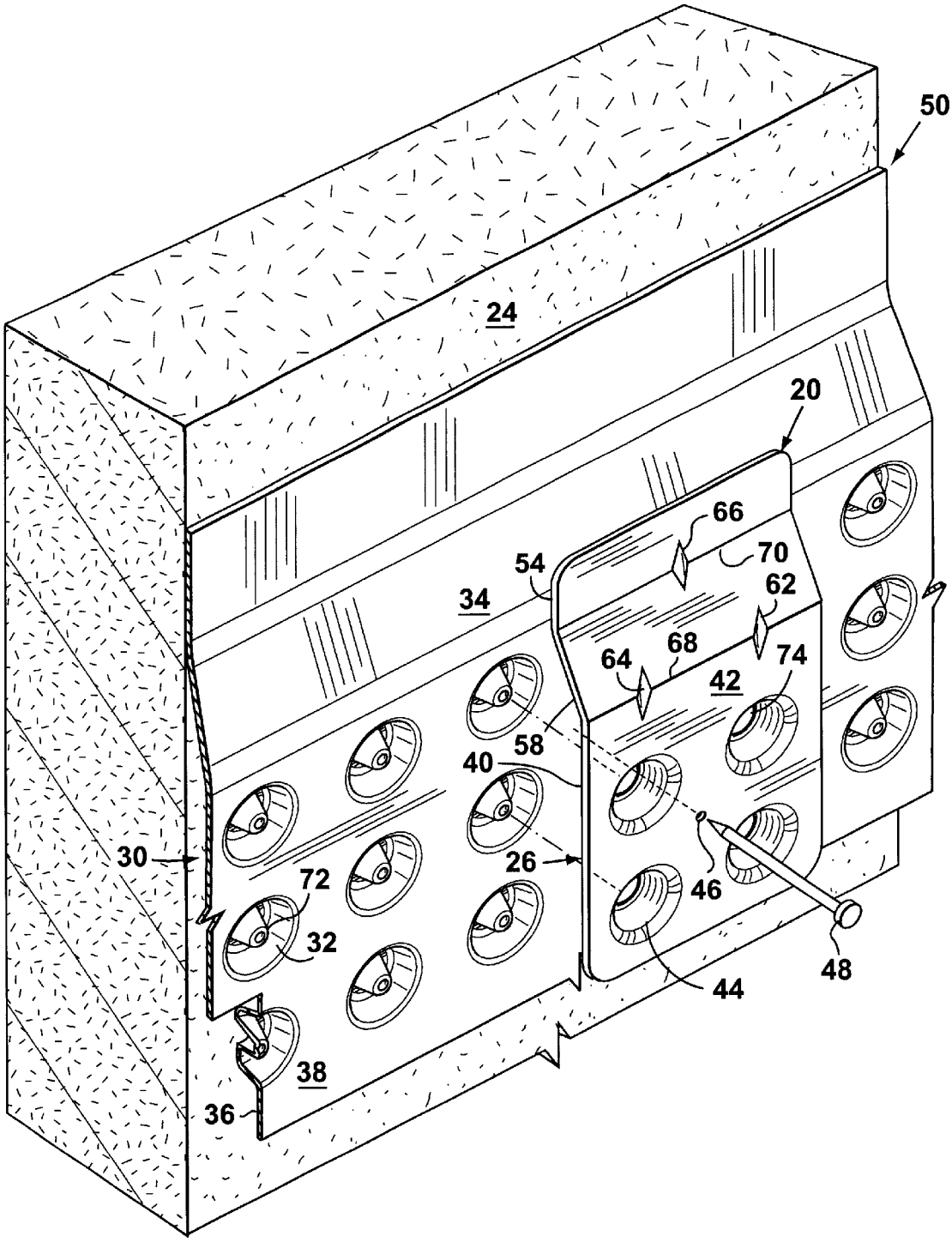
FIG. 1A is an isometric explode view of the fastening plate and the substrate of FIG. 1.
Figure 1B:
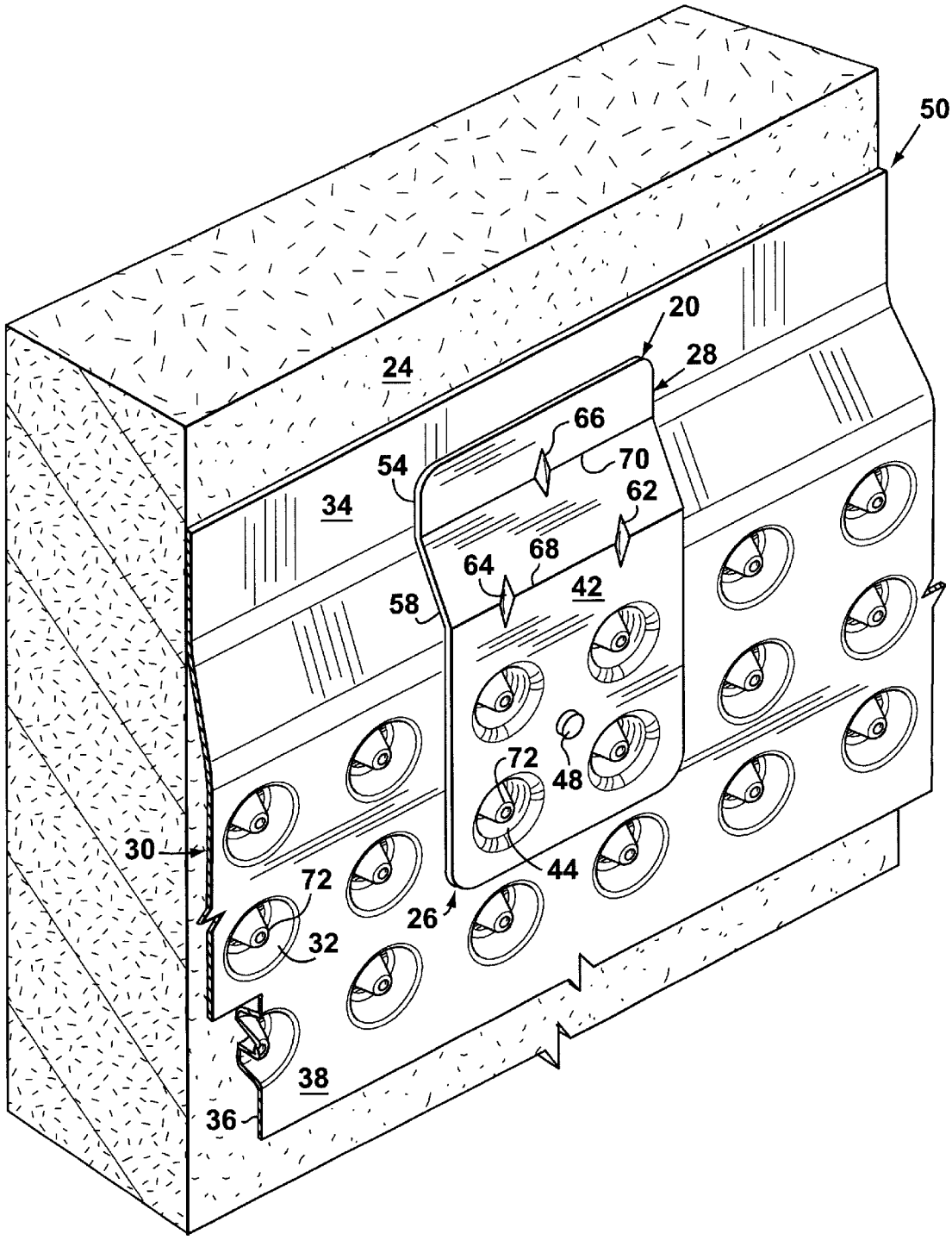
FIG. 1B is an isometric view of the fastening plate and the substrate of FIG. 1.

Reference is first made to FIG. 1 to describe a preferred embodiment of a fastening plate indicated generally by the numeral 20 in accordance with the invention. As can be seen in FIG. 1, the fastening plate 20 is used to secure a membrane 22 to a substrate 24. The fastening plate 20 includes a mating portion 26 and a biasing portion 28. The membrane 22 has a dimpled portion 30 including an array of dimples 32 and a substantially smooth portion 34. FIG. 1 shows the fastening plate 20 in position on the membrane 22, with the mating portion 26 disposed on the dimpled portion 30 of the membrane 22, and the biasing portion 28 disposed on the smooth portion 34 of membrane 22.

Figure 3:
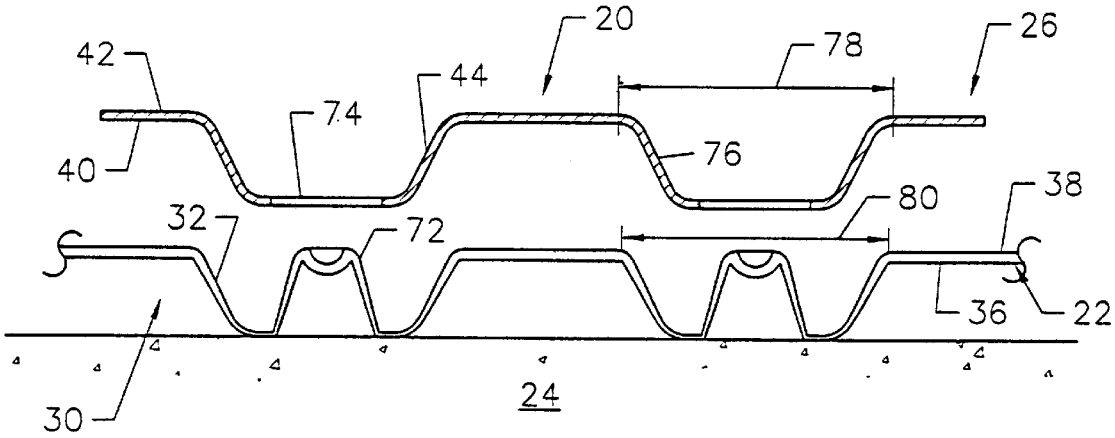
FIG. 3 is a cross-section of the fastening plate of FIG. 2, taken along line 3—3 in FIG. 2 and a partial cross-section of the membrane, prior to positioning the fastening plate on the membrane.
Figure 4:
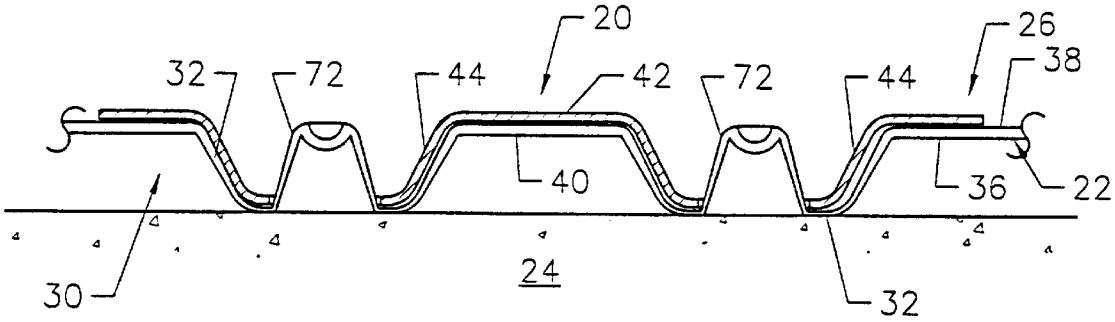
FIG. 4 is a cross-section of the fastening plate of FIG. 2, taken along line 3—3 in FIG. 2 and a partial cross-section of the membrane, showing the fastening plate positioned on the membrane.

As illustrated in FIG. 3, the membrane 22 has an inner side 36 positioned adjacent to the substrate 24 and an outer side 38 disposed opposite to the inner side 36. FIG. 3 also shows that the dimples 32 form depressions on the outer side 38 and corresponding projections from the inner side 36.

It can also be seen in FIG. 3 that the mating portion 26 of the fastening plate 20 includes a contact side 40, to be positioned adjacent to the outer side 38 of the membrane 22, and an exposed side 42 disposed opposite to the contact side 40. An array of locator elements 44 projects inwardly from the contact side 40. The locator elements 44 are adapted to cooperate with a corresponding number of the dimples 32 to position the mating portion 26 of the fastening plate 20 on the dimpled portion 30 of the membrane 22, so that the biasing portion 28 of the fastening plate 20 is positioned on the smooth portion 34 of the membrane 22, as shown in FIGS. 1 and 3–5. As can also be seen in FIG. 1, the mating portion 26 preferably includes an aperture 46 for receiving a fastener 48. The mating portion 26 is adapted to receive a fastener 48, and, for example, may not include an aperture 46. Preferably, the fastener 48 is a nail or a screw, depending on the substrate 24. For example, if the substrate 24 is an insulated concrete form, then the fastener 48 would be a screw. If the substrate 24 is concrete or wood, then the fastener 48 would preferably be a nail.

Figure 5:
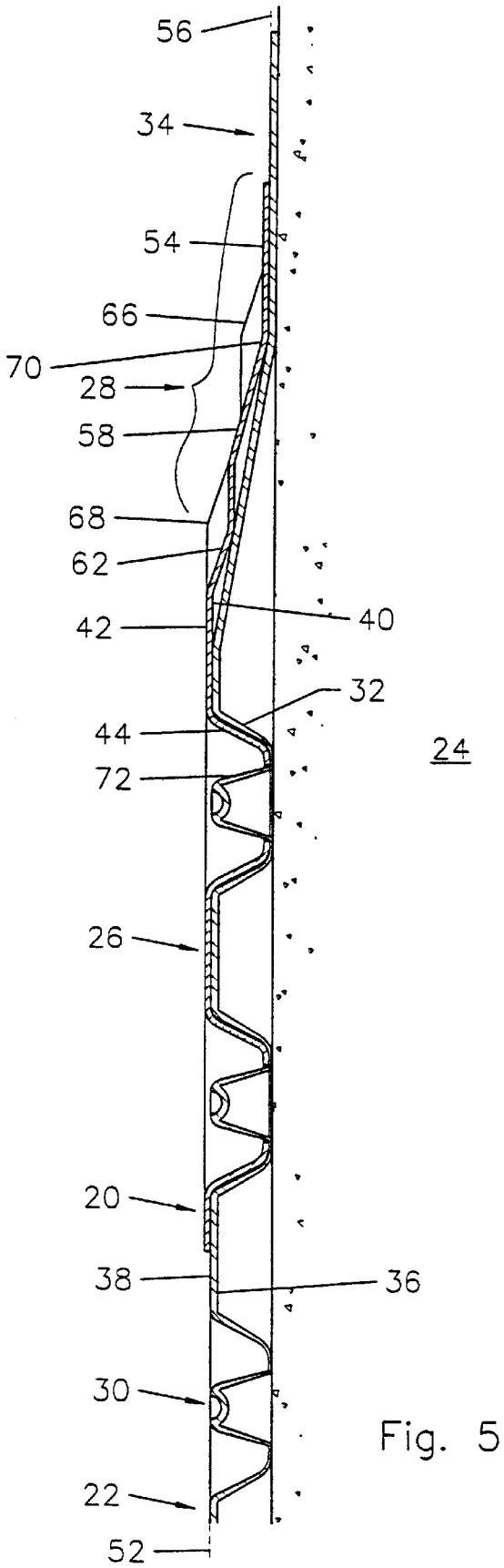
FIG. 5 is a cross-section of the fastening plate of FIG. 2, taken along line 5—5 in FIG. 2 and a partial cross-section of the membrane, showing the fastening plate positioned on the membrane.
Figure 6:
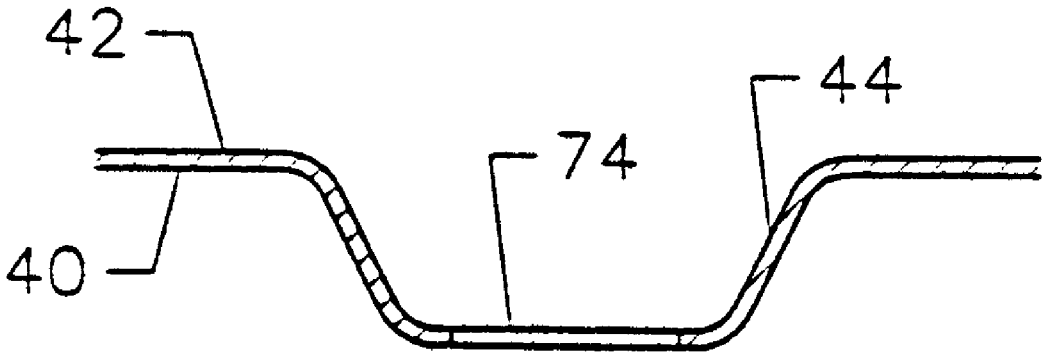
FIG. 6 is a cross-section of a locator element in the fastening plate of FIG. 2, taken along line 5—5 in FIG. 2, and drawn to a larger scale.
Figure 7:
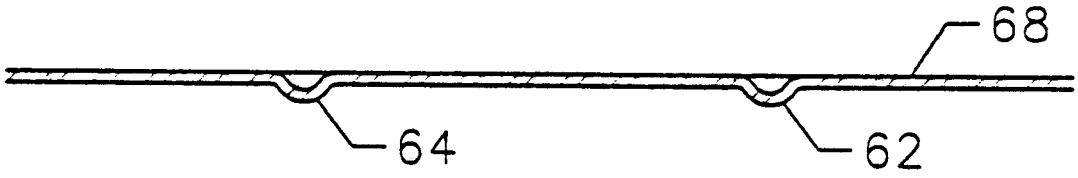
FIG. 7 is a cross-section of the fastening plate of FIG. 2, taken along line 7—7 in FIG. 2.
Figure 8:
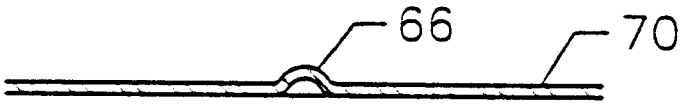
FIG. 8 is a cross-section of the fastening plate of FIG. 2, taken along line 8—8 in FIG. 2.

The position of the mating portion 26 relative to the biasing portion 28 is shown in FIG. 5. The biasing portion 28 is disposed so that, when the mating portion 26 is positioned on the dimpled portion 30 of the membrane 22, the biasing portion 28 urges the smooth portion 34 of the membrane 22 against the substrate 24.

The membrane 22 can be made of any suitable material, such as high-density polyethylene. The fastening plate 20 is made of any suitably rigid material, such as light gauge steel. If the fastening plate 20 is made of light gauge steel, then it can be formed using a sequence of dies and presses, or by any other suitable means of forming the fastening plate 20.

In use, the inner side 36 of the membrane 22 is first placed adjacent to the substrate 24. Next, the contact side 40 of the fastening plate 20 is placed adjacent to the outer side 38 of the membrane 22. The fastening plate 20 is then positioned relative to the dimpled portion 30 and the smooth portion 34 by the cooperation of the locator elements 44 with a corresponding number of dimples 32. Due to such cooperation, the mating portion 26 is disposed on the dimpled portion 30 of the membrane 22, and the biasing portion 28 is disposed on the smooth portion 34 of the membrane 22. Installation of the fastening plate 20 is completed by inserting a fastener 48 through the aperture 46 in the mating portion 26, and fastening the fastening plate 20 to the substrate 24, thereby causing the fastening plate 20 to secure the membrane 22 to the substrate 24.

Figure 2A:
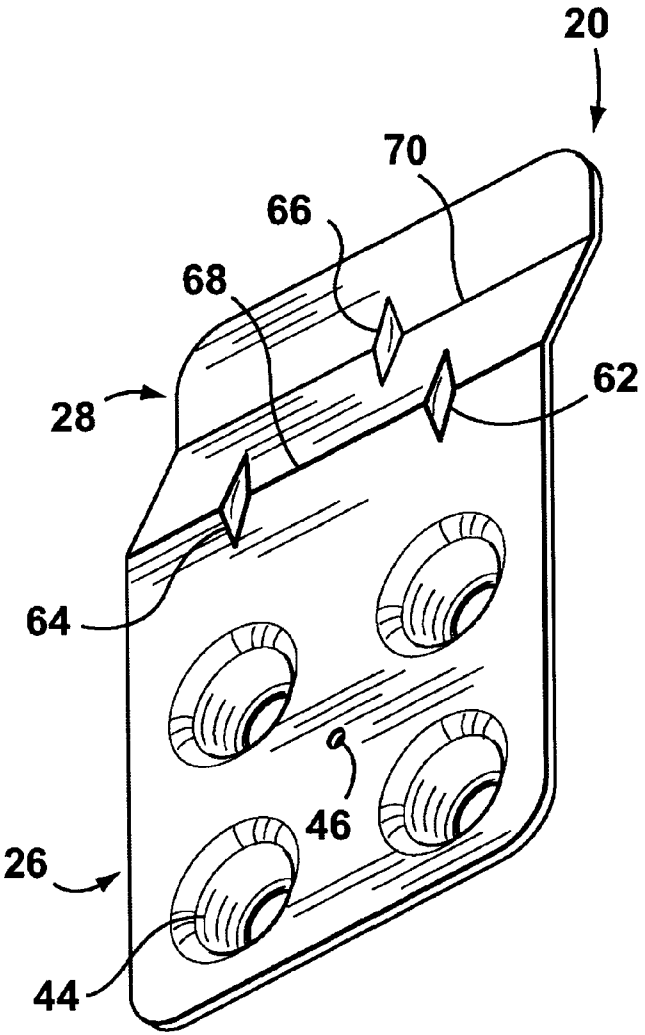
FIG. 2A is an isometric view of the fastening plate of FIG. 2.
Figure 2:
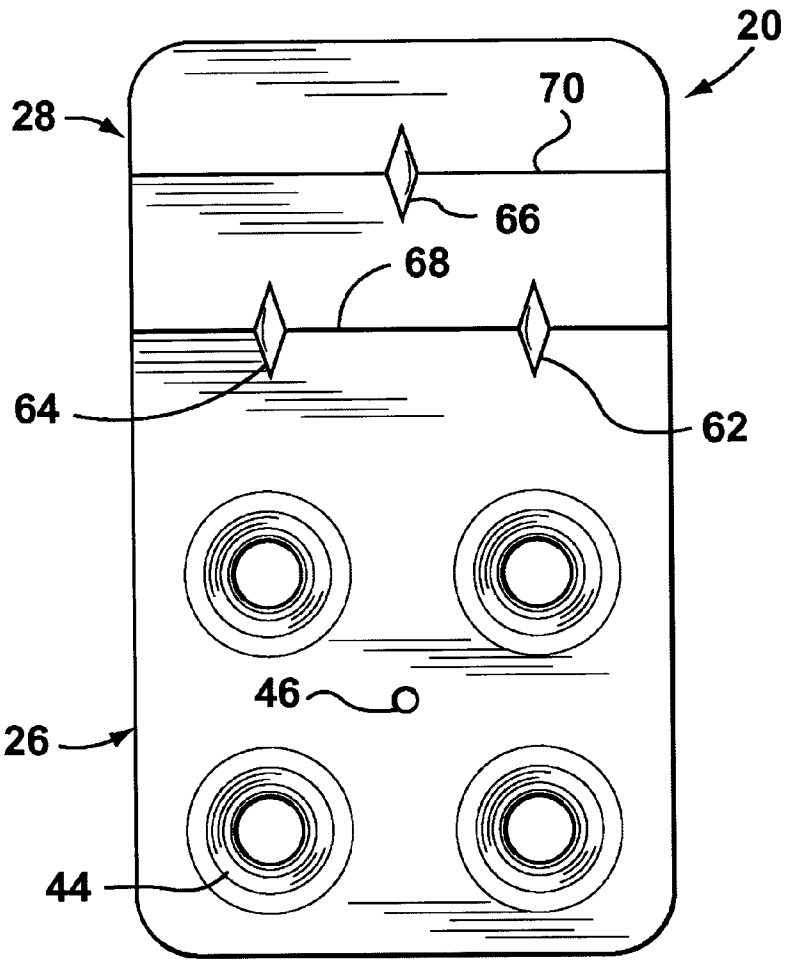
FIG. 2 is a front view of the fastening plate shown in FIG. 1.

As can be seen in FIGS. 1, 2 and 5, the biasing portion 28 includes a contact part 54 and a transverse connecting part 58. In the preferred embodiment, the transverse connecting part 58 extends between the mating portion 26 and the contact part 54 to space the contact part 54 inwardly from the contact side 40 of the mating portion 26. The contact part 54 and the transverse connecting part 58 are formed so that, when the mating portion 26 is positioned on the dimpled portion 30 of the membrane 22, the contact part 54 urges the smooth portion 34 of the membrane 22 against the substrate 24.

FIG. 2 shows the location of stiffening elements 62, 64, and 66, positioned generally on the biasing portion 28. As shown in FIGS. 2 and 5, the stiffening element 62 comprises a depression formed along a first edge 68 formed where the transverse connecting part 58 connects with the mating portion 26. Stiffening element 64 is similar to stiffening element 62. Similarly, stiffening element 66 comprises a bulge on a second edge 70 formed where the contact part 54 is connected to the transverse connecting part 58. The effect of the stiffening elements 62, 64, and 66 is to increase the resistence of the fastening plate 20 to deformation of the fastening plate 28 when the fastening plate 20 is fastened to the substrate, and the biasing portion 28 urges the smooth portion 34 of the membrane 22 against the substrate 24.

The dimples 32 in the membrane 30 include protuberances 72 extending from the dimples 32 toward the outer side 38 of the membrane 22. In the preferred embodiment of the fastening plate 20, each locator element 44 includes a locator aperture 74 for receiving a protuberance 72.

Preferably, the locator elements 44 include locator element sides 76 projecting inwardly from the contact side 40 of the mating portion 26. As can be seen in FIG. 3, the locator element sides 76 have outer diameters 78, at the contact side 40, which are less than inner diameters 80 of the dimples 32. The locator element sides 76 cooperate with the dimples 32 to position the mating portion 26 on the dimpled portion 30 and the biasing portion 28 on the smooth portion 34 of the membrane 22.

As can be seen in FIG. 1, a sheathing assembly 50 includes the membrane 22, the fastening plate 20, and at least one fastener 48. In use, the membrane 22 is positioned on the substrate 24 so that the smooth portion 34 is located at the top of the membrane 22. A plurality of fastening plates 20 are fastened to the substrate 24, spaced from each other, in order to secure the membrane 22 against the substrate 24. Once the sheathing assembly 50 has been installed, the membrane 22 is secured to the substrate 24 along the smooth portion 34, so that the membrane 22 hangs adjacent to the substrate 24, in a manner similar to a curtain.

Figure 9:
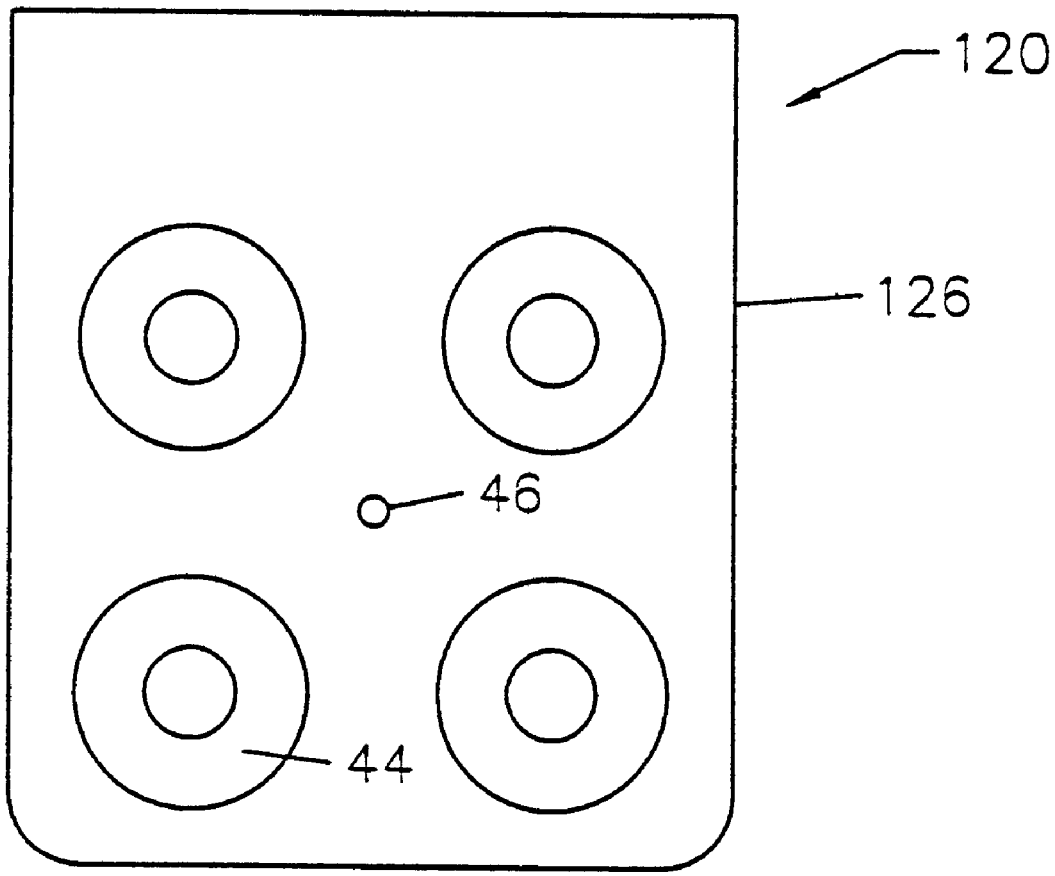
FIG. 9 is a front view of another embodiment of the fastening plate of the invention.

Another embodiment of a fastening plate 120 is shown in FIG. 9 in which the fastening plate comprises only a mating portion 126. Elements in FIG. 9 are numbered so as to correspond to like elements shown in FIGS. 1 through 8.

As can be see in FIG. 9, the mating portion 126 includes locator elements 44, for cooperating with dimples 32 on the membrane 22 to position the fastening plate 120 on the dimpled portion 30 of the membrane 22 so that the aperture 46 is positioned between the dimples 32. As noted above, alternatively, the mating portion 126 is adapted to receive a fastener 48, and the mating portion 126 may not include an aperture 46.

The fastening plate 120 could be used, for example, where it is desirable or necessary to secure the membrane 22 to the substrate 24 at a point positioned significantly lower on the substrate 24 than the smooth portion 34. Such a situation can arise, for instance, where backfill soil (not shown) includes a significant proportion of clay. When the membrane 22 is secured to the substrate only along a smooth portion 34, such backfill material tends to pull a membrane 22 down relative to a substrate 24, sometimes resulting in a torn membrane 22. As one example, using the fastening plate 120 to secure the membrane 22 to the substrate 24 at a point approximately midway between the footing (not shown) and the smooth portion 34 of the membrane 22 can secure the membrane 22 sufficiently to the substrate 24 to prevent tearing of the membrane 22 in such conditions.

Figure 10:
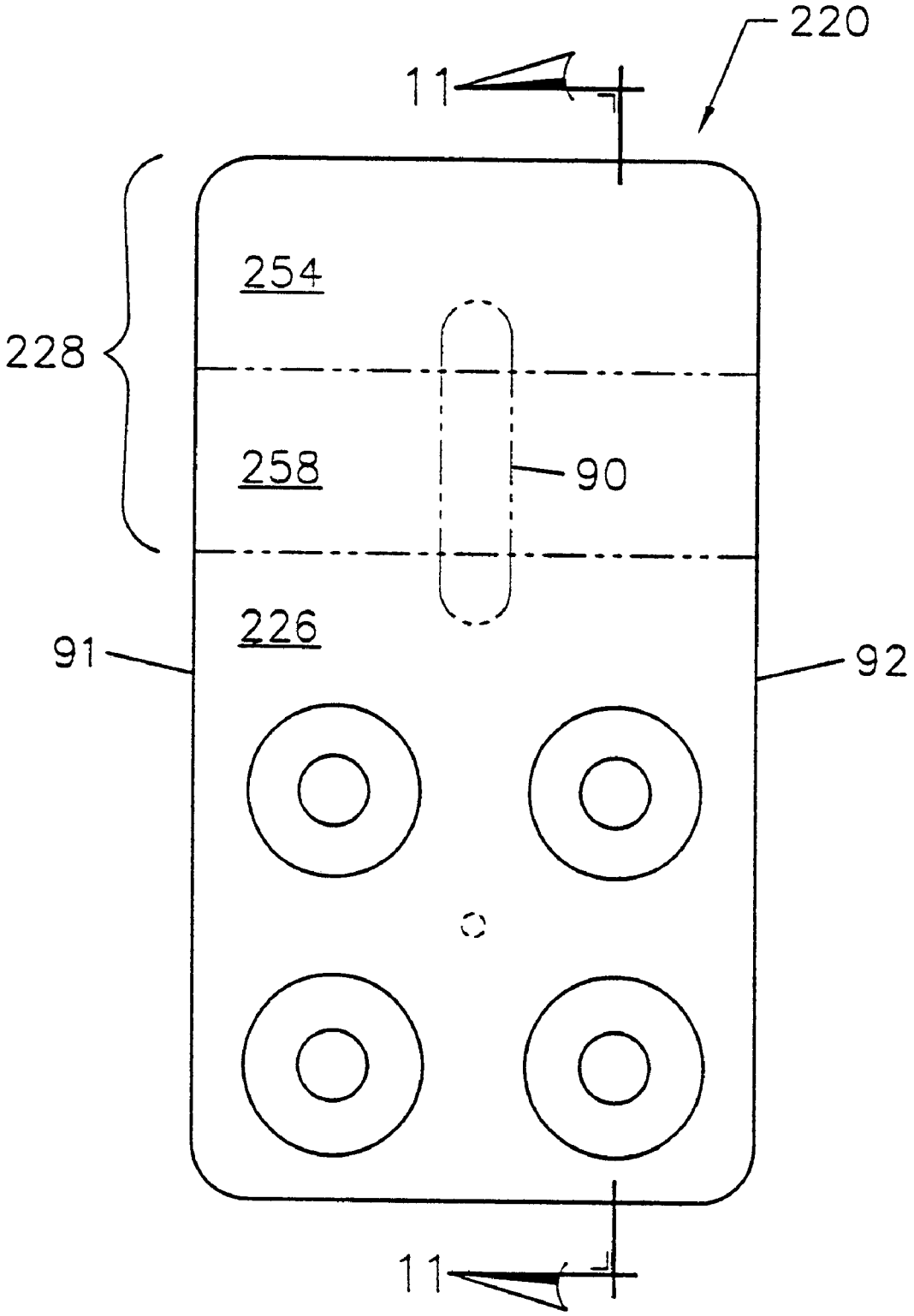
FIG. 10 is a front view of yet another embodiment of the fastening plate of the invention.
Figure 11:
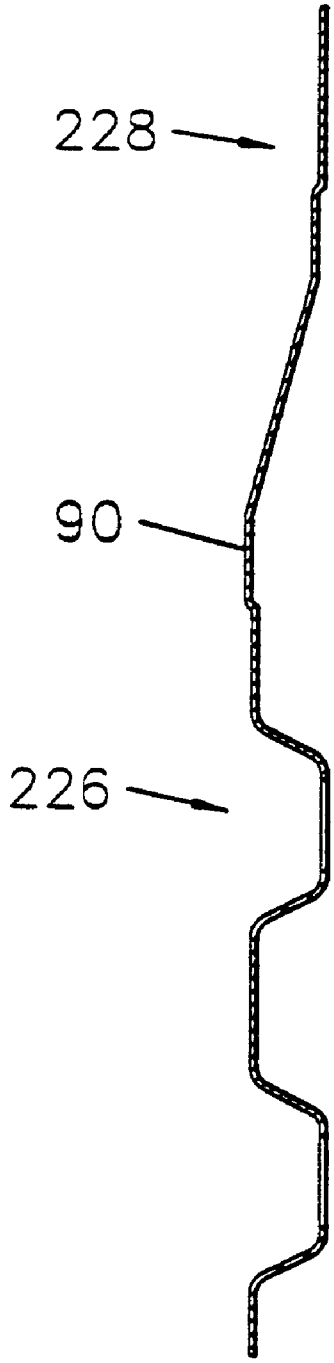
FIG. 11 is a cross-section of the fastening plate of FIG. 10, taken along line 11—11 in FIG. 10.

Another embodiment of a fastening plate 220 is shown in FIG. 10. Elements in FIGS. 10 and 11 are numbered so as to correspond to like elements shown in FIGS. 1 through 8. As can be seen in FIG. 10, the fastening plate 220 has a mating portion 226 and a biasing portion 228. The biasing portion 228 includes a contact part 254 and a transverse connecting part 258 which connects the contact part 254 to the mating portion 226.

FIG. 10 shows that the fastening plate 220 includes a ridge 90 extending from the contact part 254, through the transverse connecting part 258, and into the mating portion 226. As can be seen in FIG. 10, the fastening plate 220 is substantially rectangular and has two opposing sides 91, 92 extending along a length of the fastening plate 220 between the mating portion 226 and the biasing portion 228. The ridge 90 is positioned substantially midway between the opposing sides 91, 92 of the fastening plate 220. As can be seen in FIG. 11, the ridge 90 protrudes outwardly, that is, from the exposed side 42 of the fastening plate 220 in a direction away from the contact side 40 of the fastening plate 220. The ridge 90 serves to stiffen the fastening plate 220. The ridge 90 has the advantages that it is relatively simple and inexpensive to form the ridge 90 when the fastening plate 220 is formed.

Figure 12:
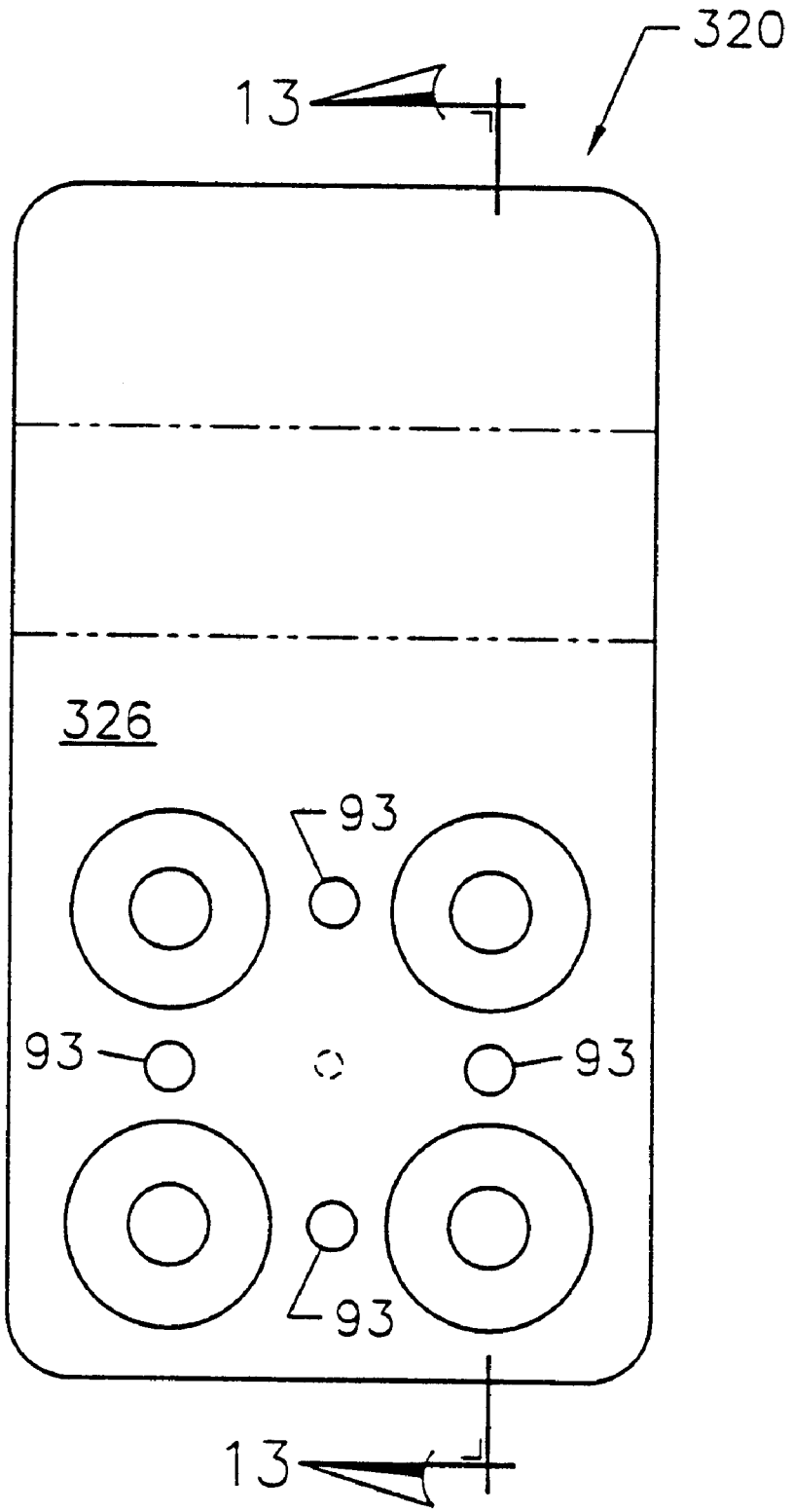
FIG. 12 is a front view of yet another embodiment of the fastening plate of the invention.
Figure 13:
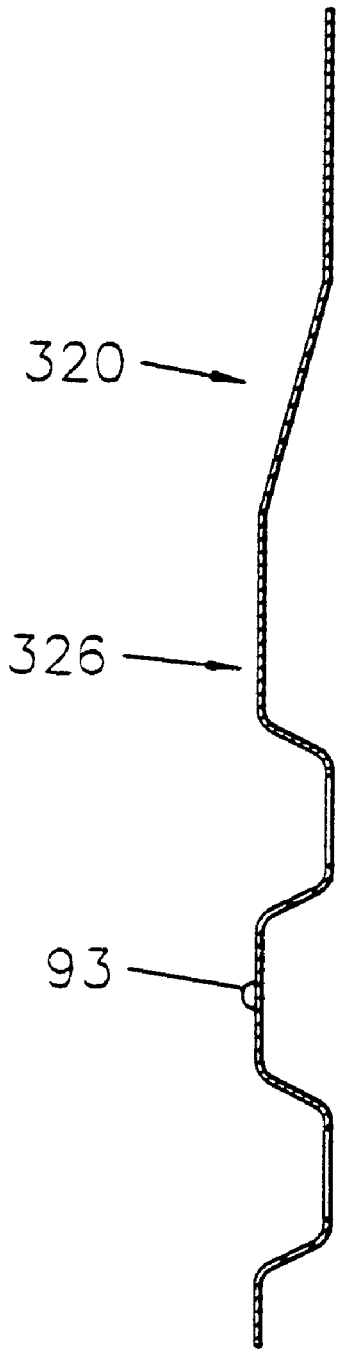
FIG. 13 is a cross-section of the fastening plate of FIG. 12, taken along line 13—13 of FIG. 12.

FIG. 12 is a front view of yet another embodiment of a fastening plate 320. Elements in FIGS. 12 and 13 are numbered so as to correspond to like elements shown in FIGS. 1 through 8. The fastening plate 320 includes a plurality of locator nubs 93 projecting outwardly from the exposed side 42 of the mating portion 326. In other words, when the fastening plate 320 is fastened to the substrate 24 and holding the membrane 22 against the substrate 24, the locator nubs 93 protrude in an outwardly direction, away from the substrate 24.

Typically, a fastener 48 is inserted in the aperture 46 by a fastener delivery device (not shown). For example, the fastener delivery device can be a nail gun. The locator nubs 93 are for cooperating with the fastener delivery device to align the fastener delivery device for insertion of the fastener 48 into the aperture 46. As shown in FIG. 12, the locator nubs 93 are substantially equidistant from the aperture 46, but the locator nubs 93 may not be equidistant from the aperture 46. Accordingly, it can be seen that the locator nubs 93 facilitate rapid installation of the fastening plate 320.

Figure 14:
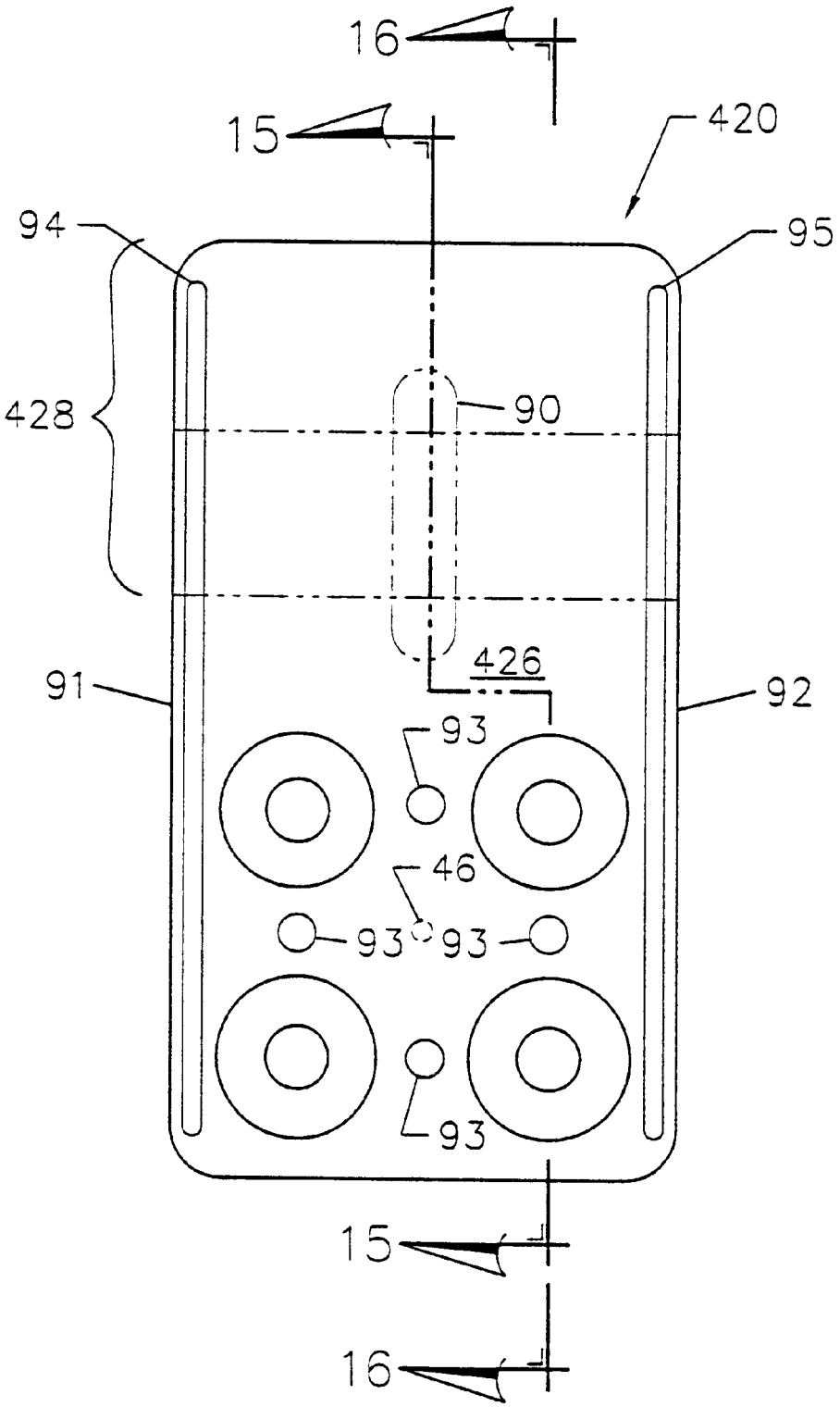
FIG. 14 is a front view of yet another embodiment of the fastening plate of the invention.
Figure 15:
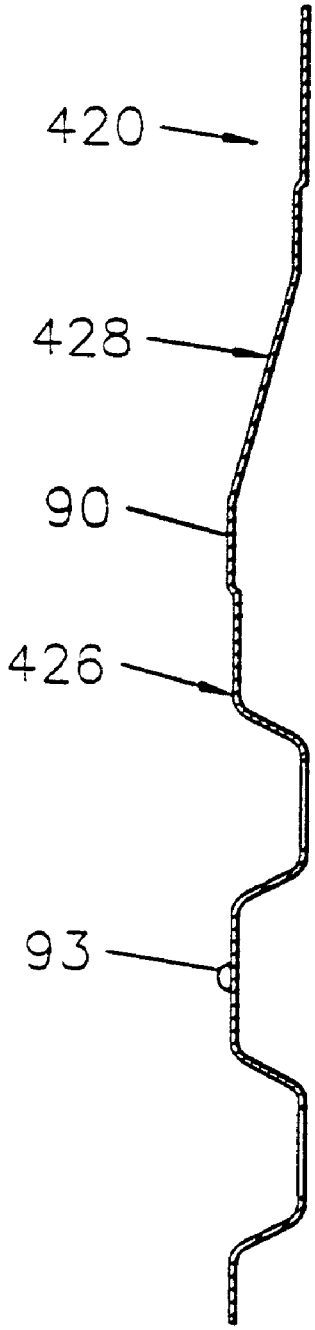
FIG. 15 is a cross-section of the fastening plate of FIG. 14, taken along line 15—15 in FIG. 4.
Figure 16:
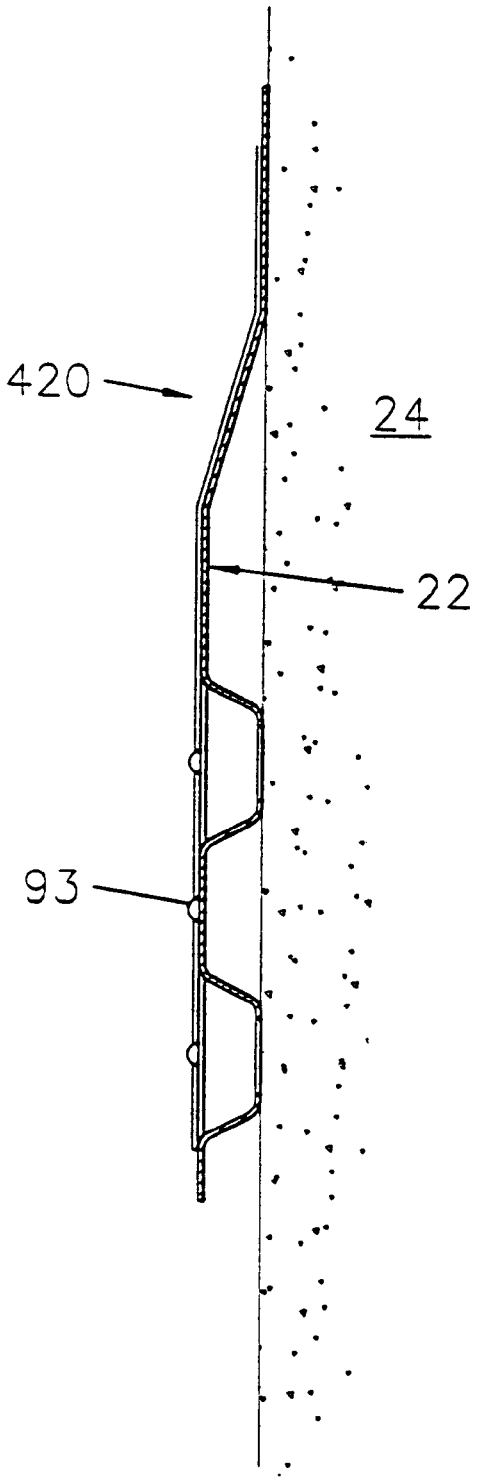
FIG. 16 is a cross-section of the fastening plate of FIG. 14, taken along line 16—16 in FIG. 14 and a partial cross-section of the membrane, showing the fastening plate positioned on the membrane.

FIG. 14 is a front view of yet another embodiment of a fastening plate 420. As in the foregoing descriptions of other embodiments, elements in FIGS. 14, 15 and 16 are numbered so as to correspond to like elements shown in FIGS. 1 through 13. The fastening plate 420 includes a mating portion 426 and a biasing portion 428. As can be seen in FIG. 14, the fastening plate is substantially rectangular and has a pair of side ridges 94, 95 formed along a length of the fastening plate 420 at the opposing sides 91, 92 respectively. The two side ridges 94, 95 extend between the mating portion 426 and the biasing portion 428 and substantially along the length of the fastening plate 420. The side ridges 94, 95 serve to stiffen the entire fastening plate 420. FIG. 14 also shows that the fastening plate 420 also includes a ridge 90 and a plurality of locator dimples 93. Among other things, the two side ridges 94, 95 tend to resist buckling of the fastening plate 420 when the fastener 48 is inserted into the aperture 46.

It will be evident to those skilled in the art that the invention can take many forms, and that such forms are within the scope of the invention as claimed. For example, it will be appreciated that, although the array of locator elements 44 as shown in the accompanying drawings is in a square pattern, the array of locator elements 44 can be in any pattern matching the corresponding array of dimples 32 on the membrane 22. The spirit and scope of the appended claims should not be limited to the description of the embodiments contained herein.

We claim:

1. A fastening plate for securing a membrane to a substrate, the membrane having an inner side to be positioned adjacent to the substrate and an outer side disposed opposite to said inner side, and the membrane having a dimpled portion including an array of dimples and a substantially smooth portion, the dimples forming depressions on the outer side and corresponding projections from the inner side, the fastening plate having:

(a) a mating portion including a contact side to be positioned adjacent to the outer side of the membrane and an exposed side disposed opposite to said contact side;

(b) a biasing portion extending from an upper area of the mating portion, for urging the smooth portion of the membrane against the substrate;

(c) the mating portion including an array of locator elements projecting inwardly from the contact side and adapted to cooperate with a corresponding number of the dimples to position the mating portion on the dimpled portion such that the biasing portion is positioned adjacent to the smooth portion of the membrane; and (d) the mating portion being adapted to receive at least one fastener for securing the fastening plate to the substrate.

2. A fastening plate as defined in claim 1 wherein the mating portion includes at least one aperture for receiving said at least one fastener.

3. A fastening plate as defined in claim 1 wherein the biasing portion includes a contact part and a transverse connecting part, the contact part being substantially planar and the transverse connecting part extending between the mating portion and the contact part to space the contact part inwardly from the contact side of the mating portion.

4. A fastening plate as defined in claim 1 wherein the biasing portion includes at least one stiffening element for resisting deformation of the fastening plate.

5. A fastening plate as defined in claim 4 which is substantially rectangular and has two opposing sides extending along a length of the fastening plate from the mating portion into the biasing portion, and in which the stiffening element is a ridge formed substantially midway between the opposing sides of the fastening plate, the ridge extending substantially from the mating portion and into the biasing portion and substantially along the biasing portion.

6. A fastening plate as defined in claim 2, having a plurality of locator nubs proximate to the aperture projecting outwardly from the exposed side of the mating portion for cooperating with a fastener delivery device to locate the fastener delivery device proximate to the aperture.

7. A fastening plate as defined in claim 1 which is substantially rectangular and has a pair of side ridges formed along a length of the fastening plate on opposite sides thereof and extending between the mating portion and the biasing portion for stiffening the fastening plate.

8. A fastening plate as claimed in claim 1 wherein the locator elements include holes for receiving protuberances extending from the dimples toward the outer side of the membrane.

9. In a sheathing assembly for securing a membrane to a substrate, the sheathing assembly including the membrane, a fastening plate and at least one fastener, the fastening plate having at least one aperture for receiving said at least one fastener, the membrane having a dimpled portion including an array of dimples, and a smooth portion which is substantially planar, the membrane having an inner side to be positioned adjacent to the substrate and an outer side disposed opposite said inner side, the dimples forming depressions on the outer side and corresponding projections from the inner side, and the fastening plate having a contact side to be positioned adjacent to the outer side of the membrane and an exposed side disposed opposite said contact side, the improvement in which the fastening plate has an array of locator elements projecting inwardly from said contact side and adapted to cooperate with a corresponding number of dimples formed on the outer side of the membrane to position the fastening plate on the dimpled portion.

10. A sheathing assembly as defined in claim 9 wherein the fastening plate has a mating portion and a biasing portion, the mating portion including the locator elements and said at least one aperture, the biasing portion being formed to urge the smooth portion of the membrane against the substrate.

11. A sheathing assembly as defined in claim 10 wherein the biasing portion includes a contact part and a transverse connecting part, the transverse connecting part extending between the mating portion and the contact part to space the contact part inwardly from the contact side of the mating portion.

12. A sheathing assembly as defined in claim 10 wherein the biasing portion includes at least one stiffening element, for resisting deformation of the fastening plate.

13. A sheathing assembly as defined in claim 12 in which the fastening plate is substantially rectangular and has two opposing sides extending along a length of the fastening plate between the mating portion and the biasing portion, and in which the stiffening element is a ridge formed substantially midway between the lateral edges of the fastening plate, the ridge extending substantially along the biasing portion and into the mating portion.

14. A sheathing assembly as defined in claim 9, having a plurality of locator nubs projecting outwardly from the exposed side of the mating portion for cooperating with a fastening delivery device.

15. A sheathing assembly as defined in claim 9 in which the fastening plate is substantially rectangular and has a pair of side ridges formed along a length of the fastening plate on opposite sides thereof and extending between the mating portion and the biasing portion for stiffening the fastening plate.

16. A sheathing assembly as claimed in claim 9 wherein the locator elements include holes for receiving protuberances extending from the dimples toward the outer side of the membrane.

17. A method of securing a membrane to a substrate by a fastening plate and at least one fastener, the membrane having a dimpled portion including an array of dimples and a smooth portion which is substantially planar, the membrane having an inner side to be positioned adjacent to the substrate and an outer side disposed opposite said inner side, the dimples forming depressions on the outer side and corresponding projections from the inner side, the fastening plate having a contact side to be positioned adjacent to the outer side of the membrane, and an exposed side disposed opposite said contact side, the fastening plate having a mating portion including an array of locator elements projecting inwardly from the contact side and adapted to cooperate with a corresponding number of dimples and at least one aperture for receiving said at least one fastener, and a biasing portion, the biasing portion extending from said mating portion, the method comprising:

(a) placing the inner side of the membrane adjacent to the substrate;

(b) placing the contact side of the fastening plate adjacent to the outer side of the membrane;

(c) positioning the fastening plate relative to the dimpled portion and the smooth portion by cooperation of the locator elements with a corresponding number of dimples, such that the mating portion is disposed on the dimpled portion, and the biasing portion is disposed on the smooth portion; and (d) inserting said at least one fastener through said at least one aperture to secure the fastening plate to the substrate, whereby the biasing portion urges the smooth portion against the substrate.

18. A fastening plate for securing a membrane to a substrate, the membrane having an inner side to be positioned adjacent to the substrate and an outer side disposed opposite said inner side, and the membrane having a dimpled portion including an array of dimples and a substantially smooth top portion, the dimples forming depressions on the outer side and corresponding projections from the inner side, the fastening plate having:

(a) a mating portion including a contact side to be positioned adjacent to the outer side of the membrane and an exposed side disposed opposite to said contact side;

(b) the mating portion being adapted to receive at least one fastener; and (c) the mating portion including an array of locator elements projecting inwardly from the contact side and adapted to cooperate with a corresponding number of the dimples to position the mating portion on the dimpled portion such that the aperture is positioned between the dimples.

19. The fastening plate as defined in claim 18 wherein the mating portion includes at least one aperture for receiving said at least one fastener.

* * * * *

UNITED STATES PATENT AND TRADEMARK OFFICE

CERTIFICATE OF CORRECTION

PATENT NO. : 6,523,309 B1
DATED : February 25, 2003
INVENTOR(S) : Shane Finlay and Pieter Greidanus It is certified that error appears in the above-identified patent and that said Letters Patent is hereby corrected as shown below:

Column 10,
Line 16, replace "the" with -- an --.

Signed and Sealed this

Ninth Day of September, 2003

JAMES E. ROGAN
*Director of the United States Patent and Trademark Office*